US006016641A

United States Patent [19]

Nagano

[11] Patent Number: 6,016,641

[45] **Date of Patent: *Jan. 25, 2000**

[54] APPARATUS AND METHOD FOR APPLYING A TUBULAR MEMBER OVER AN ARTICLE

[75] Inventor: Satoshi Nagano, Osaka, Japan

[73] Assignee: Fuji Seal, Inc., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/639,681

[22] Filed: Apr. 29, 1996

[51] Int. Cl.[7] ..... B65B 9/00

[52] U.S. Cl. ..... 53/298; 53/291; 53/292; 53/585

[58] Field of Search ..... 53/291, 292, 296, 53/297, 585, 298

[56] References Cited

U.S. PATENT DOCUMENTS

| | | | |
|---|---|---|---|
| 3,446,103 | 5/1969 | Foster | 83/155 X |
| 3,812,641 | 5/1974 | Bemiss | 53/296 X |
| 3,888,067 | 6/1975 | Cross et al. | 53/296 X |
| 4,016,704 | 4/1977 | Fujio | 53/292 X |
| 4,208,857 | 6/1980 | Fujio | 53/292 X |
| 4,497,156 | 2/1985 | Scheidegger | 53/296 X |
| 4,744,206 | 5/1988 | Winter | 53/296 X |
| 4,806,187 | 2/1989 | Fujisawa . | |
| 4,910,941 | 3/1990 | Nagano et al. . | |
| 5,107,733 | 4/1992 | Palmatier et al. | 83/155 X |

FOREIGN PATENT DOCUMENTS 63-29 1/1988 Japan .

*Primary Examiner*—Joseph M. Gorski
*Attorney, Agent, or Firm*—Jordan and Hamburg LLP

[57] ABSTRACT

An apparatus for applying a tubular member over an article includes means for feeding a continuous web of a flattened tubular material, means for cutting an individual tubular member from the web, a first belt conveyor unit for conveying the tubular member fed from the cutting means, a second belt conveyor unit for conveying the tubular member in such a manner as to open up at least a leading end of the tubular member as the tubular member is continuously conveyed, a mandrel for receiving the tubular member from the opened up leading end of the tubular member, and a means for sliding the tubular member along a peripheral surface of the mandrel so that the tubular member is entirely opened up. A distance between a point where the cutting means cuts the tubular member from the web of the tubular material and a point where the first belt conveyor unit starts to convey the tubular member is greater than the length of the individual tubular member.

10 Claims, 10 Drawing Sheets

APPARATUS AND METHOD FOR APPLYING A TUBULAR MEMBER OVER AN ARTICLE

BACKGROUND OF THE INVENTION

This invention relates to an apparatus and method for opening a flattened tubular member, for example, a cap seal and a label, and automatically and successively applying the tubular member over a predetermined portion of an article, for example, a bottle and the like.

There has been disclosed the apparatus of this type, for example, in Japanese Patent Application Laid-open No. 63-29, which includes a feed roller for feeding a continuous web of a flattened tubular material towards a mandrel and applied over the same for opening the flattened tubular material, a cutting unit disposed between the feed roller and the mandrel for cutting an individual tubular member from the web, and a rotary member abutting against the tubular member on the mandrel for pulling down the tubular material towards a lower portion of the mandrel via its rotational movement.

In accordance with the above arrangement, because of the need to stop the feeding operation of the tubular material during cutting operation, the feed roller cannot continuously feed the tubular material to the cutting unit. This generally limits the speed at which the tubular member can be applied over an article.

The apparatus of this arrangement requires the steps of applying the tubular material over the mandrel from above, cutting the individual tubular member from the tubular material by the cutting unit, and pulling down the same by the rotary member. Accordingly, if the tubular material is successively fed, it is likely that the rotary member pulls the tubular material which is still in a continuous form. This may cause untimely feeding of the tubular member, and poor application of the same over the article.

It is an object of the present invention to provide an apparatus and method for applying the tubular members over the article at high speed, while securing timely and rapid feeding operation, even if the tubular material is successively fed.

SUMMARY OF THE INVENTION

In accordance with the above object, the apparatus of the present invention includes means for feeding a continuous web of a flattened tubular material, means for cutting an individual tubular member from the web, a first belt conveyor unit for conveying the tubular member fed from the cutting means, a second belt conveyor first belt conveyor unit, the tubular members can be timely conveyed throughout the operation.

The second belt conveyor unit may comprise a pair of suction belt members having a vacuum port and disposed at lateral sides of the path of the tubular members so that the tubular members pass therebetween. In this arrangement, the apparatus further includes a vacuum chamber associated with the suction belt members so that the tubular members are sucked by the suction belt members. The suction belt members each have a width smaller than that of the flattened tubular member so that at least one of parallel fold lines thereof protrudes sidewards from the suction belt members. A twisting means is disposed at a lateral side of the suction belt members for twisting the at least one of the parallel fold lines of the tubular member. The twisting of the fold line of the tubular member causes a relative slippage between opposed flat side portions of the tubular member, and consequently causes these side portions to be separated from one another. This twisting operation allows the second belt conveyor unit to equally open up the tubular member, and smoothly apply the same over the mandrel.

The above, and other objects, features and advantages of the present invention will become apparent from the detailed description thereof read in conjunction with the accompanying unit for conveying the tubular member in such a manner as to open up at least a leading end of the tubular member as the tubular member is continuously conveyed, a mandrel for receiving the tubular member from its opened up leading end, and a means for sliding the tubular member along a peripheral surface of the mandrel so that the tubular member is entirely opened up. A distance between a point where the cutting means cuts the continuous web of the tubular material into the tubular member and a point where the first belt conveyor unit starts to convey the tubular member is greater than the length of the tubular member.

In accordance with this arrangement, since the distance between the point where the cutting means cuts the tubular member from the web and the point where the first belt conveyor unit starts to convey the tubular member is greater than the length of the individual tubular member, it is unlikely that the first belt conveyor unit unintentionally pulls down the tubular member which is not completely cut from the web.

After the tubular members are cut from the web, they fall down into the first belt conveyor unit, and are conveyed to the second belt conveyor unit at a predetermined pitch. Since the second belt conveyor unit also opens up the individual tubular members and applies the same over the mandrel at the same pitch as that of the drawings.

DETAILED DESCRIPTION OF THE INVENTION

Figure 1:
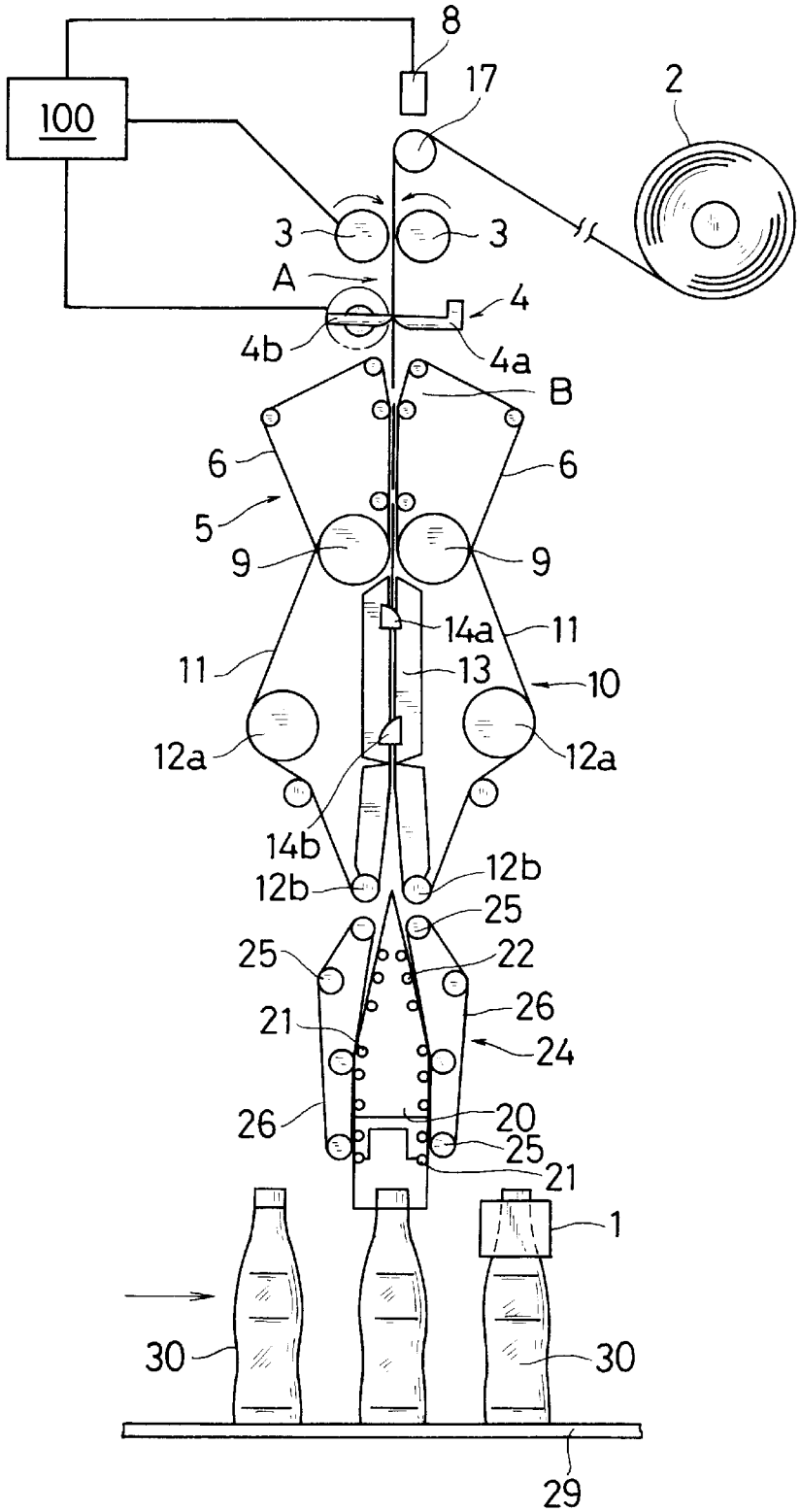
FIG. 1 is a schematic front elevation illustrating one embodiment of the present invention.

Referring to FIG. 1, a continuous web of a tubular material made of a thin and soft plastic film is flattened along its longitudinal axis, and rolled around supply roll 2. A pair of feed rollers 3 are driven to successively feed the web material from the supply roll 2 via a guide roller 17. A cutting unit 4 includes a stationary blade 4*a* and a rotary blade 4*b*, and is disposed below the feed rollers 3 to cut individual tubular members 1 from the web material. A sensor is disposed above the guide roller 17 in order to detect a predetermined marking point printed on the web material 1, and transmit a signal to a control unit 100, which controls the cutting unit 4 and the feed rollers 3 to operate in association with each other.

Figure 3:
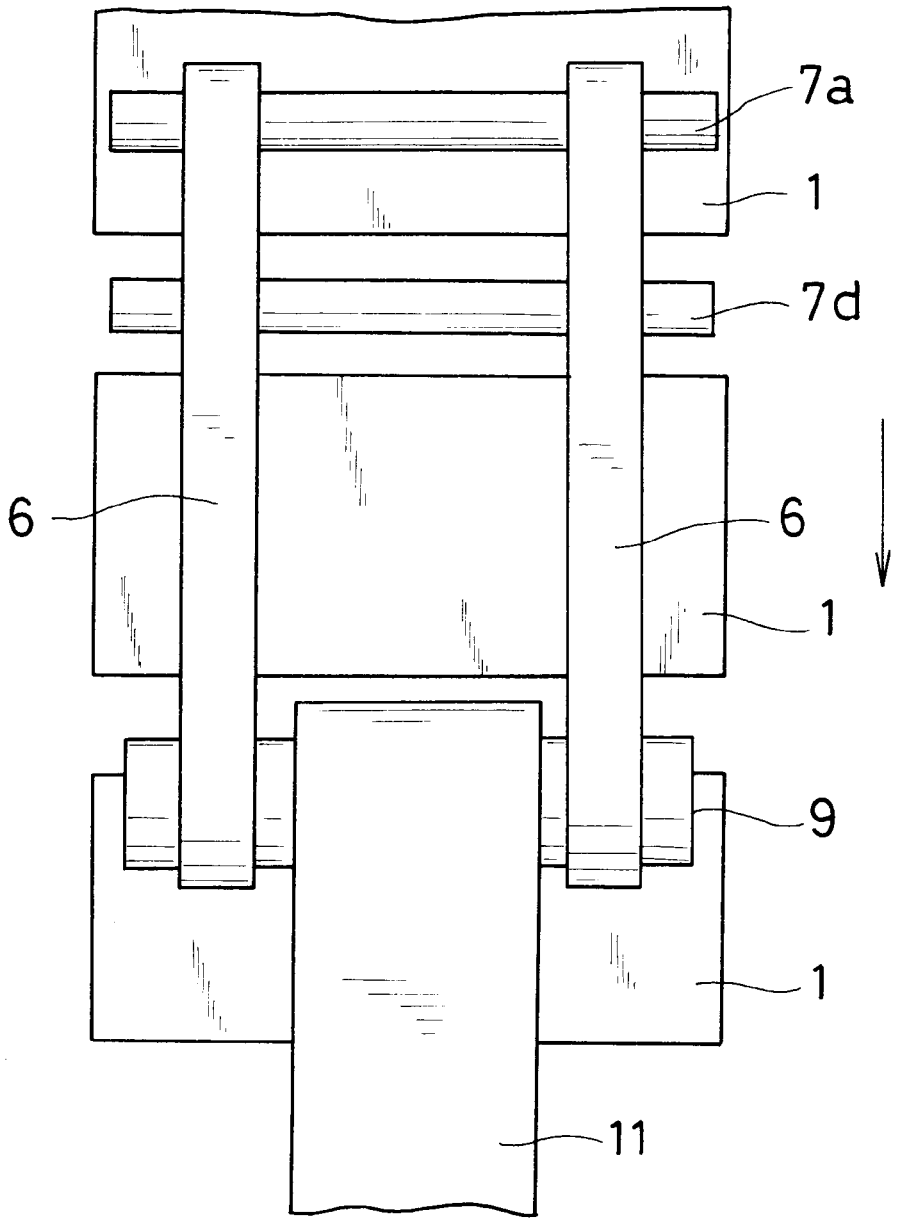
FIG. 3 is a side elevation of the essential portion of FIG. 2.

A first belt conveyor unit 5 includes two pairs of endless belt members 6, which are respectively disposed at lateral sides of the path of the tubular members 1 in order to hold each tubular member 1 by its both longitudinal sides. Each pair of the endless belt members 6 are wound around the opposite end portions of each of small guide pulleys 7*a*, 7*b*, 7*c* and 7*d*, and a large drive pulley 9, as illustrated in FIG. 3. The guide pulleys 7*a*, 7*b*, 7*c* and 7*d* guide the endless belt members 6, and the drive pully 9 disposed at the lowermost portion of the first belt conveyor unit 5 rotates the endless belt members 6 so that the endless belt members 6 of the opposite lateral sides of the path of the tubular members 1 are spaced apart from each other to define a clearance L1 at the opposing first guide pulleys 7*a*, brought into a close relationship to the opposite endless belt members 6 at the second guide pulleys 7*b*, and move straightforward to continuously press the tubular members 1 and convey the same downwards.

Figure 2:
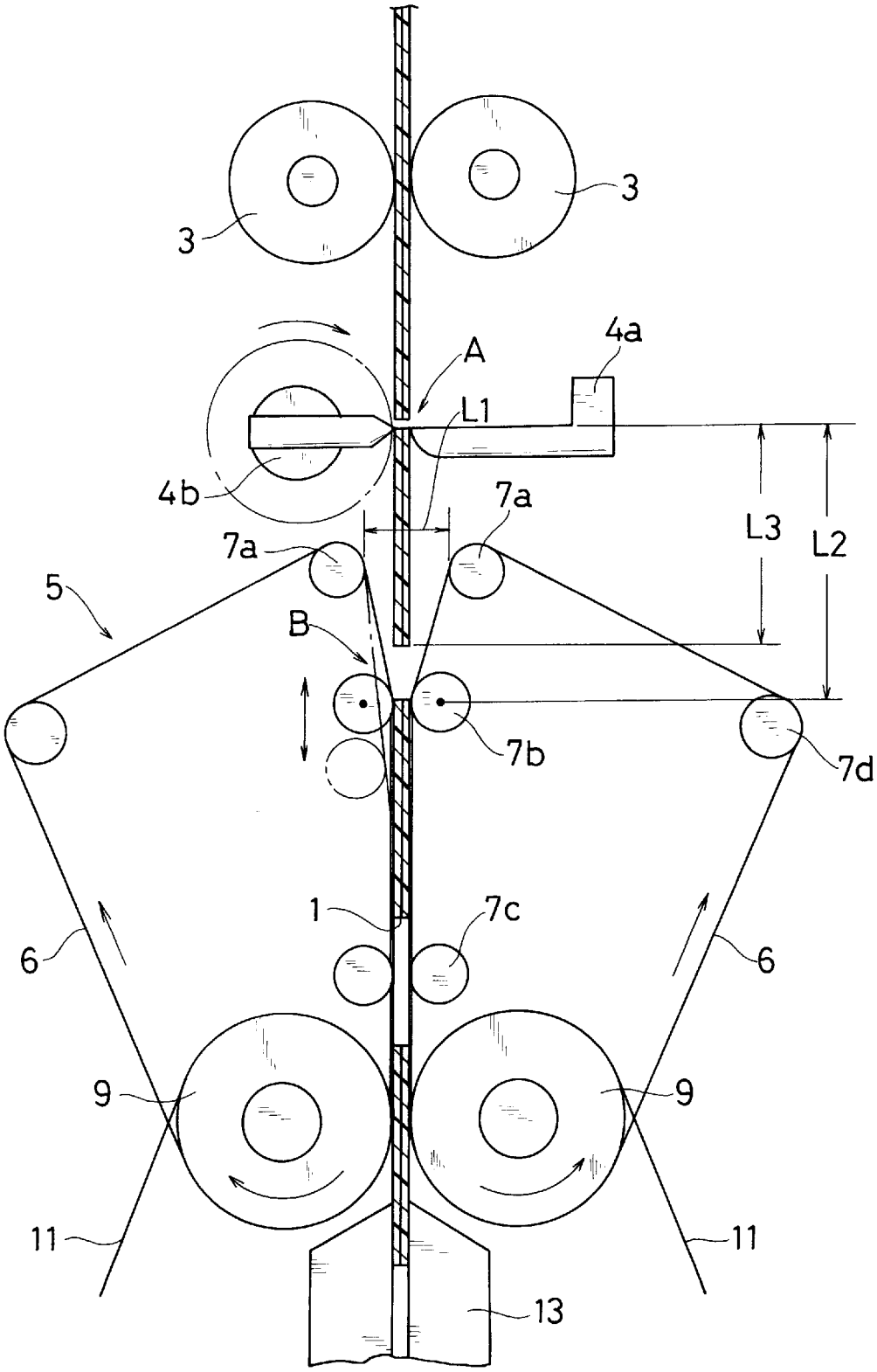
FIG. 2 is a front elevation of an essential portion of FIG. 1.

A distance L2 between a first point A where the cutting unit 4 cuts the web and a second point where the rotation axes of the second guide rollers 7*b* are is set to become greater than the length L3 of the individual tubular member 1. The first belt conveyor unit 5 starts to convey the individual tubular member 1 at the second point. The second pulleys 7*b* are movable in the upper and lower directions along the path of the tubular members 1 so that the distance L2 between the first point A and the second point B is easily adjustable. The drive pulleys 9 are controlled to rotate the belt members 6 at a predetermined speed in the directions of the arrows of FIG. 2.

A second belt conveyor unit 10 includes a pair of suction belt members 11 with a plurality of vacuum ports 11*a* defined along an entire length thereof, a plurality of large guide rollers 12*a* and small guide rollers 12*b*, and a pair of vacuum chambers 13 which are respectively disposed inside of each suction belt member 11 to be associated with the vacuum ports 11*a* of the suction belt members 11. Each suction belt member 11 is wound around the respective drive pulley 9, and the pulleys 12*a* and 12*b*, in such a manner as to be rotated substantially at the same speed as that of the endless belt members 6. As being apparent from FIG. 3, the suction belt member 11 passes between the opposite belt members 6 when winding around the respective drive pulley 9.

Figure 4A:
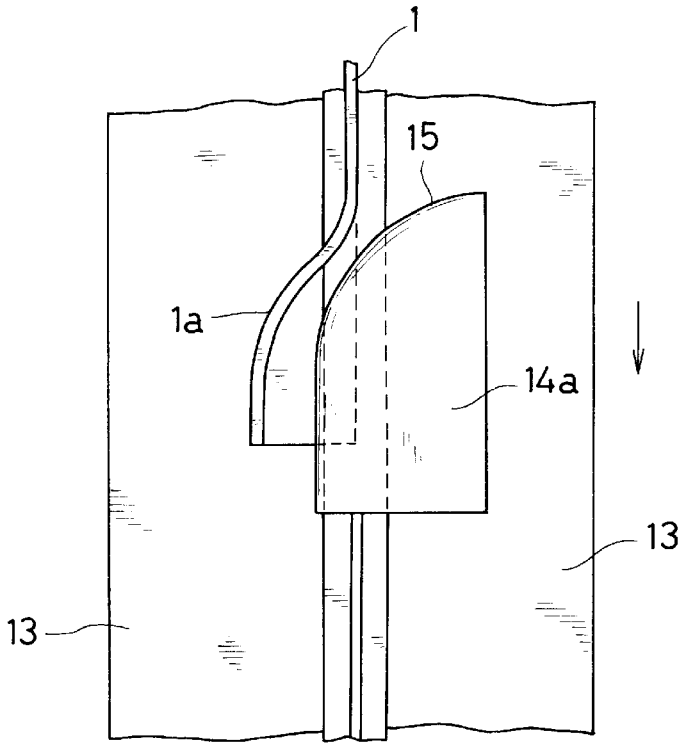
FIG. 4A is a front elevation illustrating a portion that a twisting plate twists a tubular member.
Figure 4B:
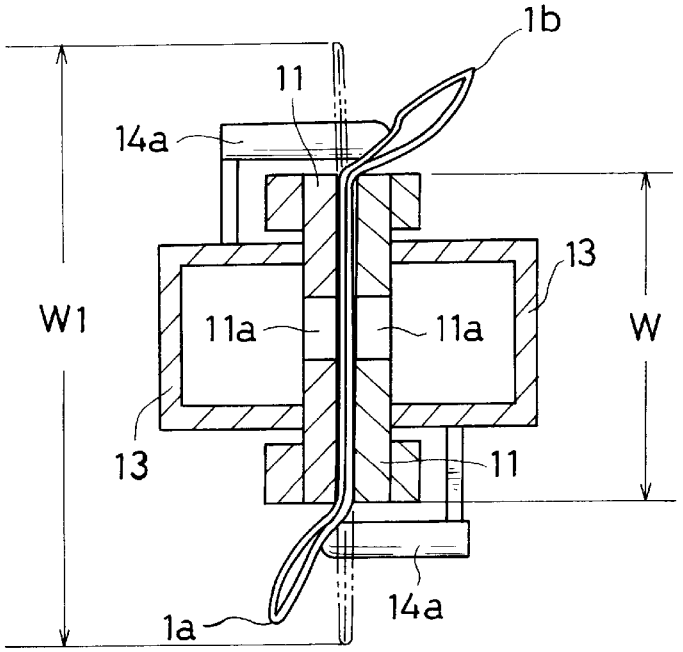
FIG. 4B is a cross sectional plan view of the portion of FIG. 4B.

Referring to FIGS. 4A and 4B, a width W of each suction belt member 11 is smaller than a width W1 between the parallel fold lines 1*a* and 1*b* of the flattened tubular member 1 so that, when the tubular member 1 passes through the suction belt members 11, the parallel fold lines protrude sidewards of the vacuum chambers 13. The vacuum chambers 13 extend downwards in a close relationship to one another at an upstream side, but gradually move away from one another as they advance in its downstream side.

A pair of upper twisting plates 14*a* and a pair of lower twisting plates 14*b* are disposed at lateral sides of the vacuum chambers 13 at different heights. Each of the twisting plates 14*a* and 14*b* has a sloping edge 15, and is disposed so that, once the tubular member 1 reaches the sloping edge 15, the respective protruding portion of the tubular member 1 slides along the sloping edge 15 and consequently is twisted in one direction, as best shown in FIG. 4A. Each sloping edge 15 faces opposite direction to those of the same and opposite lateral sides of the vacuum chambers 13. With this arrangement, the opposite protruding portions of the tubular member 1 are respectively twisted in the opposite directions to one another via the upper twisting plates 14*a*, and then oppositely twisted via the lower twisting plates 14*b*, as the suction belt members 11 convey the tubular member 1 downwards.

A mandrel 20 has a pointed top end which faces between the lower ends of the suction belt members 11, and a cylindrical body with a diameter which becomes larger as it advances downwards. A plurality of small rollers 21 and 22 are disposed inside of the mandrel 20 and slightly protrude from respective openings (not shown) defined by a peripheral wall of the mandrel 20.

A conveyor unit 24, having a pair of endless belt members 26 which are driven via a plurality of pulleys 25, are disposed at the lateral sides of the mandrel 20 in such a manner as to clamp and hold the mandrel 20 throughout the entire length thereof. Each endless belt member 26 defines a clearance to the mandrel 20 at its upper portion. The pulleys 25 disposed along a middle portion of each endless belt member 26 are disposed slightly inside of the rollers 21 of the mandrel 20, thereby loosely suspending the mandrel 20 in position via a hooking relationship between the pulleys 25 and the adjacent rollers 21.

A conveyor unit 29 is disposed below the mandrel 20 to successively feed the bottle 30 at predetermined pitch to the apparatus 28 of the present invention.

Figure 6:
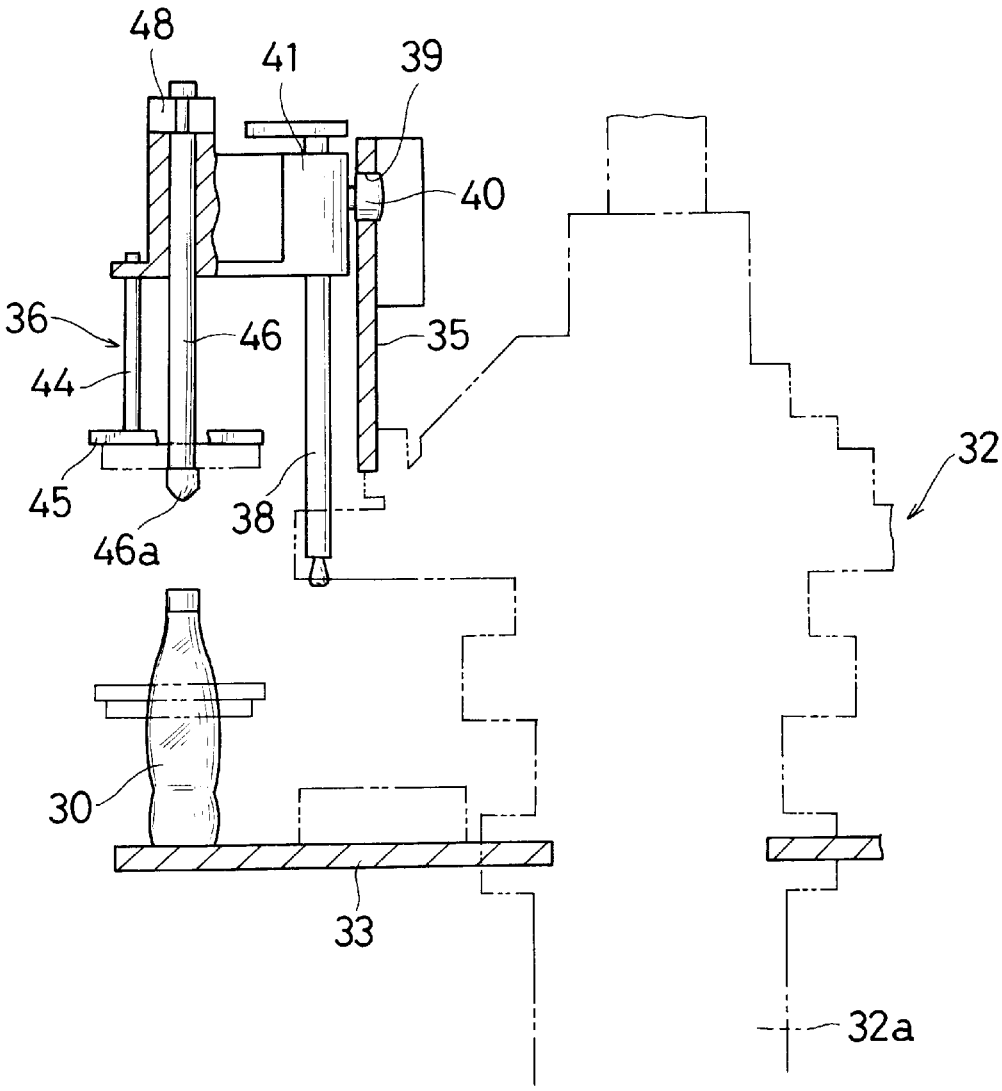
FIG. 6 is a cross sectional front elevation illustrating a tubular member positioning mechanism.
Figure 10:
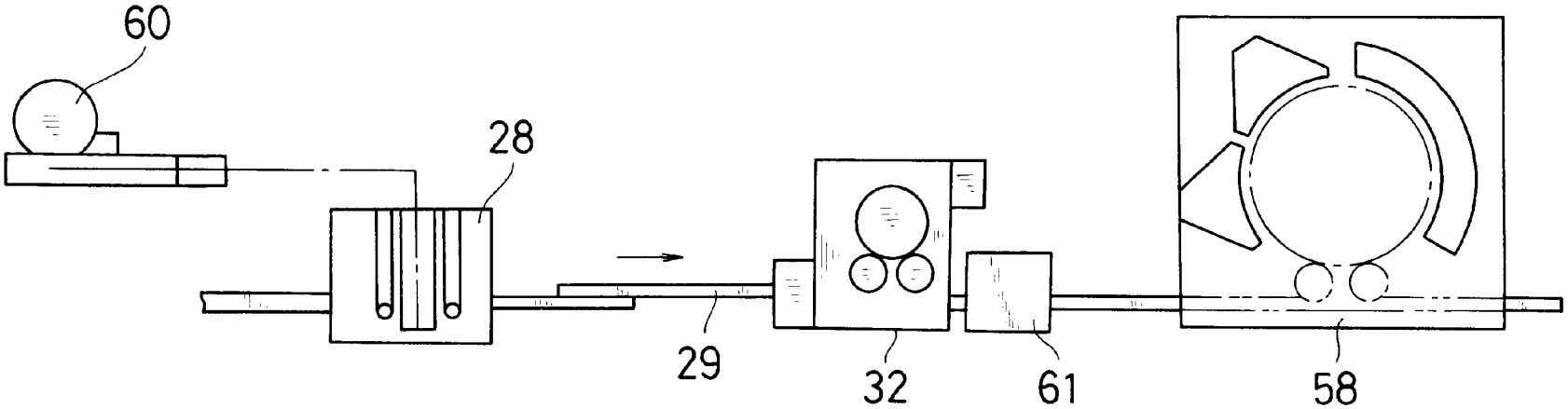
FIG. 10 is a schematic top plan view illustrating various stations including the apparatus of the present invention, through which the tubular member is securely applied over the article.

Referring to FIGS. 6 and 10, a tubular member positioning mechanism 32 includes a rotary table 33 which is rotatably supported about a rotation axis by center support 32*a*, and a plurality of pressure units 36, and is disposed at the downstream side of the apparatus 28. The pressure units 36 each include a cam follower 40 which follows a cam groove 39 of a cam plate 35 mounted on the center support 32*a*, and a pressure body 41 which is movably mounted on a pair of guide bars 38 which are, in turn, vertically mounted on the center support 32*a*.

A plurality of support bars 44 extend downwards from the pressure body 41, and are terminated by a circular plate 45 with an opening 45*a* at its center, through which a pressure bar 46 extends downward. The pressure bar 46 is movably mounted on the pressure body 41, and urged downwards by a weight 48 mounted on its upper end.

Figure 7:
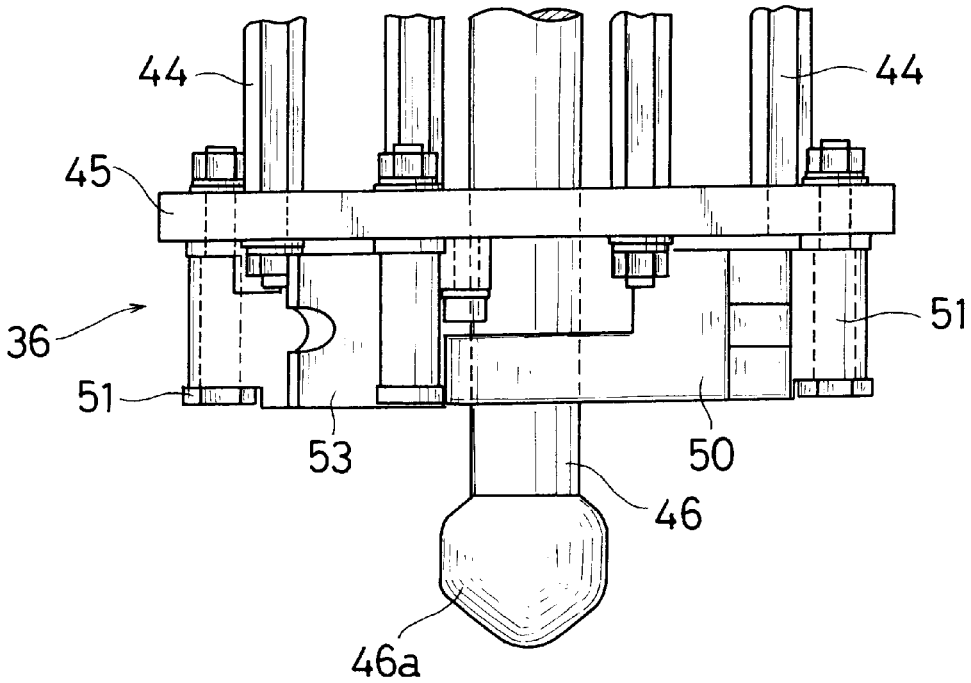
FIG. 7 is an elevational view illustrating an essential portion of the positioning mechanism of FIG. 6.
Figure 7:
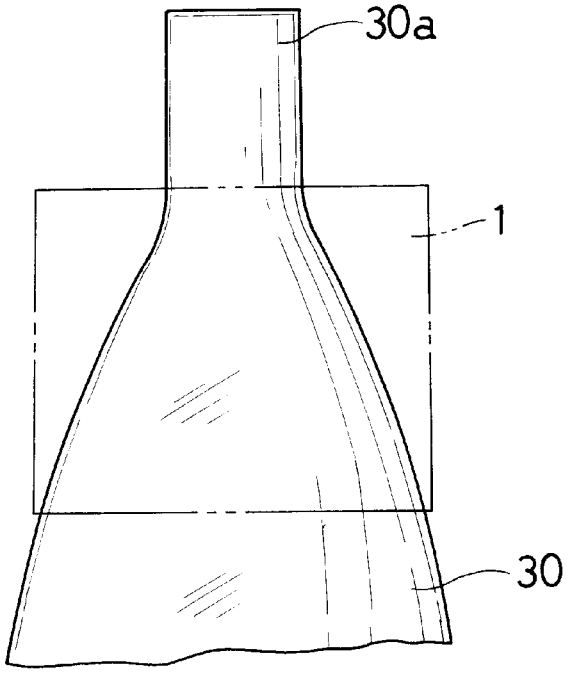
Figure 8A:
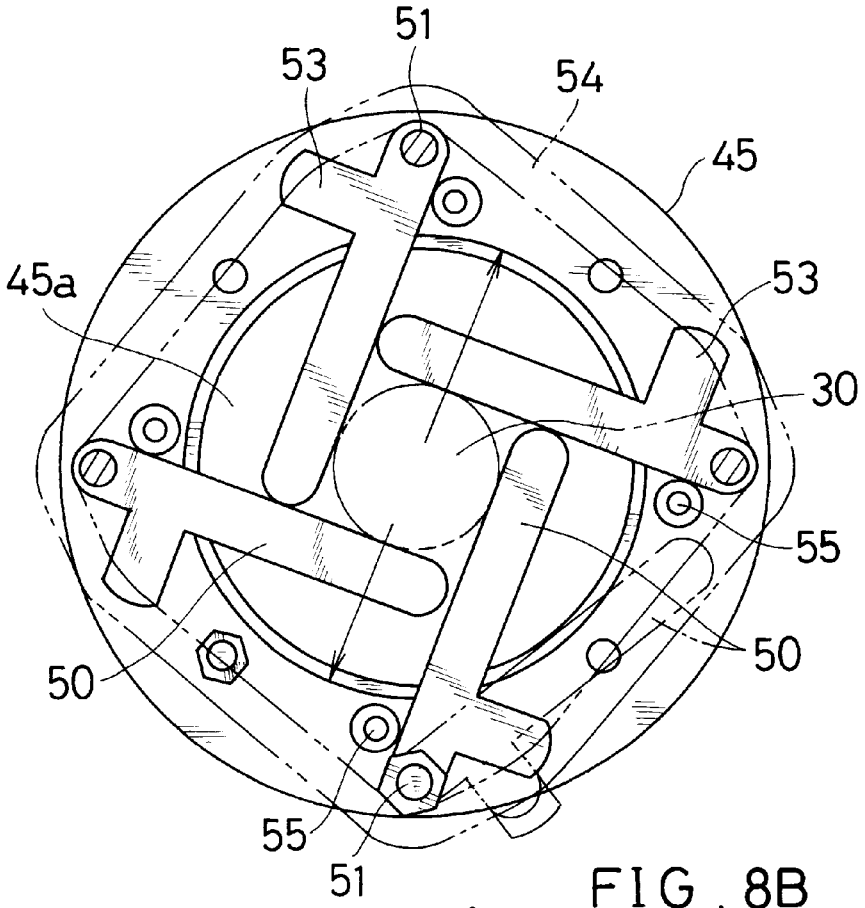
FIG. 8A is a bottom plan view with a partial cross section of the positioning mechanism.
Figure 8B:
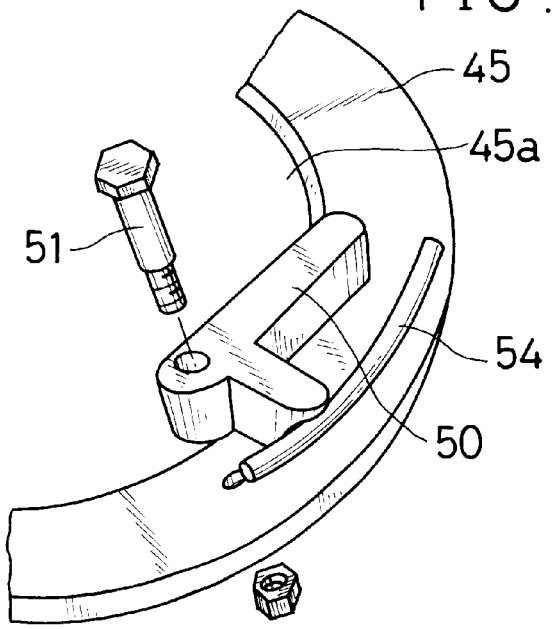
FIG. 8B is a fragmental perspective view of the portion of FIG. 8A.

Referring to FIGS. 7, 8 and 8A, a plurality of pressure arms 50 are pivotably mounted on a lower surface of the circular plate 45 via bolts 51 in such a manner as to horizontally swing around their base portions. A horizontal protrusion 53 protrudes from a side of each pressure arm 50 at a right angle in the same direction as those of the other pressure arms 50. A rubber ring 54 is wound around the base portions and the horizontal protrusions 53 of the pressure arms 50 so as to bias the pressure arms 50 radially and inwardly of the opening 45*a*. Stoppers 55 are disposed with predetermined spacing on the circulate plate 45 to limit the inward movement of the respective pressure arms 50. The diameter D of the opening 45*a* of the circulate plate 45 is larger than the diameter of a target portion of the bottle 30, around which the tubular member 1 is applied.

A heating unit 58 is disposed at the downstream side of the positioning mechanism 32 to heat the tubular member 1 applied over the bottle 30, as illustrated in FIG. 10.

The operational steps of applying the tubular member 1 over the bottle 30 will be described hereinbelow.

The continuous web of the tubular material is set in a roll feeder 60, and continuously drawn downwards from the roll by rotation of the feed rollers 3. The cutting unit 4 is operated in association with the feed rollers 3 and cut the individual tubular members 1 from the web. Since the leading ends of the tubular members 1 do not contact the endless belt members 6 during the cutting operation, the tubular member 1 is not unintentionally pulled downwards by the endless belt members 6, and is therefore correctly cut from the web of the tubular material.

The individual tubular members 1 drop from the cutting unit 4, are clamped by the endless belt members 6 and are fed to the second belt conveyor unit 10. During the conveyance by the first belt conveyor unit 5, the tubular member 1 can be conveyed straightforwards and securely fed to the suction belt members 11, since it is continuously clamped via its opposite longitudinal edges by the endless belt members 6. The tubular member 1 is conveyed by the second belt conveyor unit 10 at the same speed as that of the first belt conveyor unit 5, thereby attaining the smooth and timely conveyance of the tubular members 1 throughout the units 5 and 10.

The suction belt members 11 suck the opposed flattened sides of the tubular members 1 by the operation of the vacuum chambers 13, and convey the tubular members 1 to the downstream side of the apparatus 28. Once the tubular member 1, with the opposite longitudinal edge portions protruding sidewards from the vacuum chambers 13, reaches the upper twisting plates 14*a*, the tubular member 1 is twisted via the sloping edges 15. The tubular member 1 is then oppositely twisted via the sloping edges 15 of the lower twisting plates 14*b*. With this arrangement, even if the opposed flattened side portions of the tubular member 1 stick to one another, the twisting motions enable those side portions to be forcibly slipped sidewards and separated from one another. Thus, sticking force between the opposed flattened side portions of the tubular member 1 is weakened.

The tubular member 1 is then conveyed towards the lower portion of the second belt conveyor unit 10, where the tubular member 1 is forcibly opened up from its leading end, as the opposed flattened side portions thereof are sucked and conveyed by the respective suction belt members 11. Since the sticking force between the opposed side portions has been weakened via the twisting operation performed by the twisting plates 14*a* and 14*b*, this opening up operation is easily done, even if the opposed flattened side portions again stick to one another.

Figure 5A:
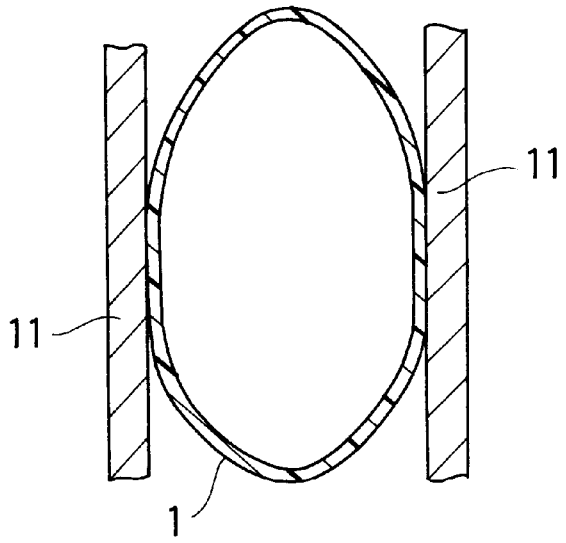
FIG. 5A is a cross sectional plan view illustrating the film in open state.
Figure 5B:
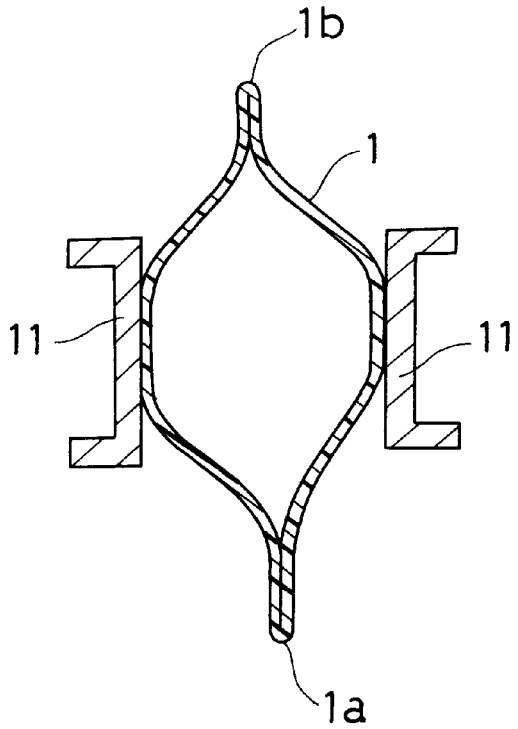
FIG. 5B is a cross sectional plan view illustrating a comparative example.

In case that the twisting plates 14*a* and 14*b* are omitted from this embodiment, a sticking portion remains near the opposite fold lines 1*a* and 1*b* of the tubular member 1 during the opening operation, as illustrated in FIG. 5B. This may cause poor application of the tubular member 1 over the mandrel 20.

The tubular member 1 applied over the mandrel 20 is pulled downwards by rotation of the endless belt members 26 of the conveyor unit 24. The endless belt members 26 convey the tubular members 1 at a speed four times faster than that of the suction belt members 11 of the second belt conveyor unit 10 to promptly pull the tubular members 1 downwards. The tubular member 1 is gradually opened up from its leading end as it slides along the mandrel 20, and is entirely opened up from its leading end to rear end at the lowermost portion of the mandrel 20. As the pulleys 25 of the conveyor unit 24 are rotated, the corresponding pulleys 22 idle so that the mandrel 20 is continuously suspended in position.

The tubular member 1 then drops from the mandrel 20 onto the top of the oncoming bottle 30 which is conveyed under the apparatus 28 by the conveyor unit 29 operated in synchronism with the conveyor unit 24. The parallel fold lines 1*a* and 1*b* of the tubular member 1 still remain, after the tubular member 1 is applied over the bottle 30, and therefore causes the tubular member 1 to come back to a flattened state. Subsequently the tubular member 1 stays around an upper portion of the bottle 30.

The bottles 30 with the tubular members 1 thereon are successively conveyed to the positioning mechanism 32 via the conveyor unit unit 29, and mounted on the oncoming pressure units 36 of the turntable 33. While the bottles 30 turn around the rotation axis 32*a* via the turntable 33, the pressure body 41 in each pressure unit 36 lowers along the guide bars 38 via cam operation of the cam groove 39 and the cam follower 40 so that a lower end 46*a* of the pressure bar 46 is introduced into a bottle top 30*a* of the bottle 30, and fixes the bottle 30 in position. Along with the rotation of the rotation axis 32*a*, the pressure body 41 further lowers so that the bottle top 30*a* of the bottle 30 is introduced into the opening 45*a* of the circular plate 45. While the pressure body 41 is lowered, the pressure arms 50 abut against the bottle 30, and swing radially and outwardly, as they slide along a periphery of the bottle 30 biased by force effected by the rubber ring 54.

Figure 9C:
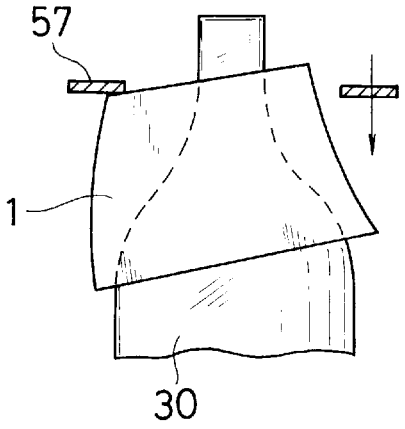
FIGS. 9A, 9B and 9C are front elevations with partial cross section illustrating consecutive steps of applying the tubular member over a bottle.
Figure 9A:
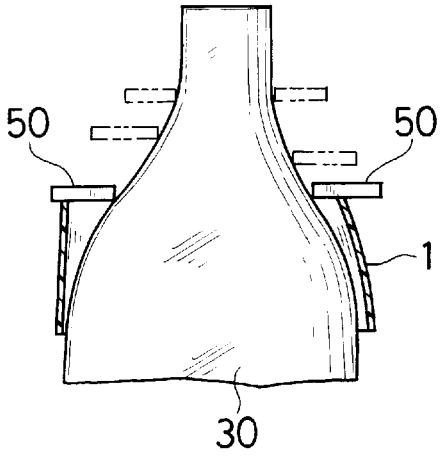
Figure 9B:
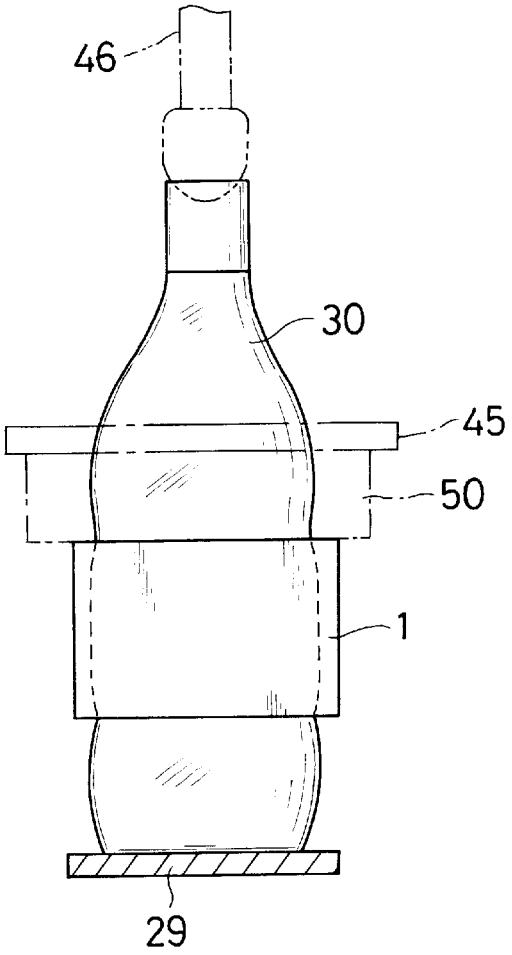

If a ring member 57 is employed in the pressure unit 36 to solely lower the tubular member 1, the tubular member 1 is likely to be slipped sidewards and incorrectly applied over the bottle 30, as illustrated in FIG. 9C. On the contrary, the pressure arms 50 of this embodiment swing radially and outwardly while sliding along the periphery of the bottle 30 so that the tubular member 1 is equally pressed, and lowered to predetermined portion of the bottle 30, as illustrated in FIGS. 9A and 9B.

After positioning the tubular member 1 to the targeted portion of the bottle 30, the pressure body 41 is elevated so that the circular plate 45 is moved away from the bottle top 30*a* of the bottle 30. The bottle 30 is then removed from the turntable 33 and mounted on the conveyor unit 29 to be conveyed to a pre-heater 61, in which the tubular member 1 is shrunk via heat in such a manner as to be temporarily fixed in position. The bottle 30 is then conveyed to a heater 63, in which the tubular member 1 is completely shrink, resulting in tight contact with the bottle 30.

In this embodiment, the steps of receiving the cut tubular member 1 and opening the tubular member 1 are performed by the first and second belt conveyor units 5 and 10, and the suction belt members 11 of the second belt conveyor unit 10 are provided with the vacuum ports 11*a* which are associated with the vacuum chambers 13. Accordingly, it is possible to employ the suction belt member 11 of a thick and rigid type, and the endless belt members 6 of a thin and easily bendable material of a low cost.

Instead of the endless belt members 26 of the conveyor unit 24, rollers may be employed to pull down the tubular member 1 along the mandrel 1. A specific arrangement of this is not limited to the above embodiment.

In addition, the tubular member 1 may be varied in material and dimension. The article on which the tubular member 1 is applied is not limited to the bottle 30. Containers of other types or other articles become targets for the present invention. The cutting unit 4 may include a pair of blades which are horizontally moved towards one another and cut the tubular material in cooperation with one another.

This specification is by no means intended to restrict the present invention to the preferred embodiments set forth therein. Various modifications to the method and apparatus of the present invention, as described herein, may be made by those skilled in the art without departing from the spirit and scope of the present invention as defined in the appended claims.

What is claimed is:

1. An apparatus for cutting a tubular member from a continuous web of flattened tubular material and applying said tubular member over an article, said apparatus comprising:

feeding means for feeding said continuous web of a flattened tubular material;

cutting means for cutting said tubular member from the continuous web, said cutting means being disposed downstream from said feeding means to receive said continuous web from said feeding means;

a belt conveyor mechanism including:

a first belt conveyor unit having first and second belt members opposingly disposed for continuously conveying the tubular member, said first belt conveyor unit being disposed below said cutting means to receive said tubular member from said cutting means, said first and second belt members engaging said tubular member at an engagement point disposed a predetermined distance below a point whereat said cutting means cuts said continuous web, and said first conveying unit having an engagement point positioning mechanism including:

first and second rollers respectively engaging said first and second belt members to urge said first and second belt members toward one another to define said engagement point between said first and second rollers and said first and second belt members, and said first and second rollers being movably disposed to travel in upward and downward directions for varying and setting a position of said engagement point at said predetermined distance;

a second belt conveyor unit for conveying the tubular member in such a manner as to open up at least a leading end of the tubular member as the tubular member is continuously conveyed, said second belt conveyor unit having third and fourth belt members disposed opposing one another for conveying the tubular member and for applying vacuum suction to said tubular member in opposing directions to open said at least leading end, said second belt conveyor unit receiving said tubular member from said first belt conveyor unit; and said first and second belt members being thinner and more flexible than said third and fourth belt members whereby receiving the tubular member at said engagement point at said predetermined distance below said cutting means and opening said at least leading end by applying said vacuum suction is respectively facilitated by said third and fourth belt members being thicker and stiffer than said first and second belt members;

application means for applying the tubular member onto said article, said application means including:

a mandrel for receiving said opened up leading end of the tubular member from said second belt conveyor unit; and a means for sliding the tubular member along a peripheral surface of said mandrel so that the tubular member is entirely opened up and for feeding said tubular member onto said article; and control means for controlling said feeding means and said cutting means to cut said tubular member to a length which is less than said predetermined distance.

2. An apparatus for cutting a tubular member from a continuous web of flattened tubular material and applying said tubular member over an article, said apparatus comprising:

feeding means for feeding said continuous web of a flattened tubular material;

cutting means for cutting said tubular member from the continuous web, said cutting means being disposed downstream from said feeding means to receive said continuous web from said feeding means;

a belt conveyor mechanism including:

a first belt conveyor unit for continuously conveying the tubular member disposed below said cutting means to receive said tubular member from said cutting means, said first belt conveyor unit engaging said tubular member at a point disposed a predetermined distance below a point whereat said cutting means cuts said continuous web; and a second belt conveyor unit for conveying the tubular member in such a manner as to open up at least a leading end of the tubular member as the tubular member is continuously conveyed, said second belt conveyor unit receiving said tubular member from said first belt conveyor unit;

said second belt conveyor means including:

a pair of suction belt members with vacuum ports disposed at lateral sides of a path of the tubular member so that the tubular member passes therebetween;

a vacuum chamber associated with said suction belt members so that said leading end of the tubular member is opened by said suction belt members via said vacuum ports, said flattened tubular member having folds at parallel edges thereof, said suction belt members each having a width smaller than that of the flattened tubular material so that at least one of said folds thereof protrudes sidewards from said suction belt members; and a twisting means disposed at a lateral side of said suction belt members for twisting said at least one of the folds, as the tubular member is conveyed;

application means for applying the tubular member onto said article, said application means including:

a mandrel for receiving said opened up leading end of the tubular member from said second belt conveyor unit; and a means for sliding the tubular member along a peripheral surface of said mandrel so that the tubular member is entirely opened up and feeding said tubular member onto said article; and control means for controlling said feeding means and said cutting means to cut said tubular member to a length which is less than said predetermined.

3. The apparatus of claim 1 wherein said feeding means continuously feeds said continuous web of said flattened tubular material.

4. An apparatus for cutting a tubular member from a continuous web of flattened tubular material and applying said tubular member over an article, said apparatus comprising:

feeding means for feeding said continuous web of a flattened tubular material;

cutting means for cutting said tubular member from said continuous web, said cutting means being disposed downstream from said feeding means to receive said continuous web from said feeding means;

a belt conveyor mechanism for continuously conveying said tubular member disposed below said cutting means to receive said tubular member from said cutting means, said belt conveyor mechanism engaging said tubular member at a point disposed a predetermined distance below a point whereat said cutting means cuts said continuous web, and said belt conveyor mechanism including means for conveying said tubular member in such a manner as to open up at least a leading end of said tubular member as said tubular member is continuously conveyed;

application means for receiving said opened up leading end of the tubular member from said belt conveyor mechanism and sliding the tubular member onto said article;

said belt conveyor mechanism including:

a pair of suction belt members with vacuum ports disposed at lateral sides of a path of the tubular member so that the tubular member passes therebetween;

at least one vacuum chamber associated with said suction belt members so that said leading end of the tubular member is opened by said suction belt members via said vacuum ports, said flattened tubular member having folds at parallel edges thereof, said suction belt members each having a width smaller than that of the flattened tubular material so that at least one of said folds thereof protrudes sidewards from said suction belt members; and a twisting means disposed at a lateral side of said suction belt members for twisting said at least one of the folds, as the tubular member is conveyed; and control means for controlling said feeding means and said cutting means to cut said tubular member to a length which is less than said predetermined distance.

5. The apparatus of claim 4 wherein said belt conveyor mechanism includes means for adjusting said point where said tubular member is engaged to vary said predetermined distance.

6. The apparatus of claim 4 wherein said feeding means continuously feeds said continuous web of said flattened tubular material.

7. The apparatus according to claim 4 wherein said application means includes:

a mandrel for receiving said opened up leading end of the tubular member from said second belt conveyor unit; and a means for sliding the tubular member along a peripheral surface of said mandrel so that the tubular member is entirely opened up and for feeding said tubular member onto said article.

8. The apparatus according to claim 7 wherein: said belt conveyor mechanism includes:

a first belt conveyor unit, for continuously conveying the tubular member, disposed below said cutting means to receive said tubular member from said cutting means, said first belt conveyor unit engaging said tubular member at said point disposed said predetermined distance below said point whereat said cutting means cuts said continuous web; and a second belt conveyor unit for conveying the tubular member in such a manner as to open up at least said leading end of the tubular member as the tubular member is continuously conveyed, said second belt conveyor unit receiving said tubular member from said first belt conveyor unit; and said application means receives said opened up leading end of the tubular member from said second belt conveyor unit.

9. The apparatus according to claim 4 wherein: said belt conveyor mechanism includes:

a first belt conveyor unit, for continuously conveying the tubular member, disposed below said cutting means to receive said tubular member from said cutting means, said first belt conveyor unit engaging said tubular member at said point disposed said predetermined distance below said point whereat said cutting means cuts said continuous web; and a second belt conveyor unit including said suction belt members and said at least one vacuum chamber, said second belt conveyor unit receiving said tubular member from said first belt conveyor unit; and said application means receives said opened up leading end of the tubular member from said second belt conveyor unit.

10. An apparatus for cutting a tubular member from a continuous web of flattened tubular material and applying said tubular member over an article, said apparatus comprising:

feeding means for feeding said continuous web of a flattened tubular material;

cutting means for cutting said tubular member from said continuous web, said cutting means being disposed downstream from said feeding means to receive said continuous web from said feeding means;

a belt conveyor mechanism for continuously conveying said tubular member disposed below said cutting means to receive said tubular member from said cutting means, said belt conveyor mechanism engaging said tubular member at a point disposed a predetermined distance below a point whereat said cutting means cuts said continuous web, and said belt conveyor mechanism including means for conveying said tubular member in such a manner as to open up at least a leading end of said tubular member as said tubular member is continuously conveyed;

application means for receiving said opened up leading end of the tubular member from said belt conveyor mechanism and sliding the tubular member onto said article;

control means for controlling said feeding means and said cutting means to cut said tubular member to a length which is less than said predetermined distance;

said belt conveyor mechanism including:

a first belt conveyor unit, for continuously conveying the tubular member, disposed below said cutting means to receive said tubular member from said cutting means, said first belt conveyor unit engaging said tubular member at said point disposed said predetermined distance below said point whereat said cutting means cuts said continuous web; and a second belt conveyor unit for conveying the tubular member in such a manner as to open up at least said leading end of the tubular member as the tubular member is continuously conveyed, said second belt conveyor unit receiving said tubular member from said first belt conveyor unit; and said second belt conveyor unit including:

a pair of suction belt members with vacuum ports disposed at lateral sides of a path of the tubular member so that the tubular member passes therebetween;

at least one vacuum chamber associated with said suction belt members so that said leading end of the tubular member is opened by said suction belt members via said vacuum ports, said flattened tubular member having folds at parallel edges thereof, said suction belt members each having a width smaller than that of the flattened tubular material so that at least one of said folds thereof protrudes sidewards from said suction belt members; and a twisting means disposed at a lateral side of said suction belt members for twisting said at least one of the folds, as the tubular member is conveyed.

* * * * *